United States Patent [19]

Sakamoto et al.

[11] Patent Number: 5,009,706

[45] Date of Patent: Apr. 23, 1991

[54] RARE-EARTH ANTISOTROPIC POWDERS AND MAGNETS AND THEIR MANUFACTURING PROCESSES

[75] Inventors: Hiroaki Sakamoto; Masahiro Fujikura; Toshio Mukai, all of Kawasaki, Japan

[73] Assignee: Nippon Steel Corporation, Tokyo, Japan

[21] Appl. No.: 554,109

[22] Filed: Jul. 18, 1990

Related U.S. Application Data

[63] Continuation of Ser. No. 475,460, Feb. 6, 1990, abandoned.

[30] Foreign Application Priority Data

Aug. 4, 1989 [JP] Japan ..... 1-202675

[51] Int. Cl.[5] ..... C22C 29/14

[52] U.S. Cl. ..... 75/244; 75/230; 75/246; 75/252; 148/103; 148/108; 419/12; 419/23; 419/33; 419/37; 419/38; 419/43; 419/54; 419/57; 419/60

[58] Field of Search ..... 75/230, 244, 246, 252; 148/103, 108; 419/12, 23, 33, 37, 38, 43, 54, 57, 60

[56] References Cited

U.S. PATENT DOCUMENTS

| | | | |
|---|---|---|---|
| 4,810,309 | 3/1989 | Coehoorn | 148/302 |
| 4,844,754 | 7/1989 | Lee | 148/302 |
| 4,851,058 | 7/1989 | Croat | 143/302 |
| 4,859,255 | 9/1989 | Fujimura et al. | 148/302 |
| 4,863,805 | 9/1989 | Suzuki et al. | 428/558 |
| 4,867,809 | 9/1989 | Haverstick | 148/101 |
| 4,881,986 | 11/1989 | Sato et al. | 148/103 |
| 4,892,596 | 1/1990 | Chatterjee | 148/104 |
| 4,895,607 | 1/1990 | Choong-Jin | 148/104 |
| 4,913,745 | 4/1990 | Sato | 148/103 |
| 4,920,009 | 4/1990 | Lee et al. | 428/552 |
| 4,925,501 | 5/1990 | Harasek | 148/101 |

FOREIGN PATENT DOCUMENTS

| | | |
|---|---|---|
| 59-46008 | 3/1984 | Japan . |
| 59-64739 | 4/1984 | Japan . |
| 60-100402 | 6/1985 | Japan . |
| 62-203302 | 9/1987 | Japan . |
| 64-704 | 1/1989 | Japan . |
| 64-7504 | 1/1989 | Japan . |
| 64-39702 | 2/1989 | Japan . |

*Primary Examiner*—Brooks H. Hunt
*Assistant Examiner*—N. Bhat
*Attorney, Agent, or Firm*—Kenyon & Kenyon

[57] ABSTRACT

Rare-earth alloy anisotropic powders consist of, in atomic percent, over 12 percent and not more than 20 percent of R (R is at least one on neodymium and praseodymium or at least one of them and or more rare-earth elements), not less than 4 percent and not more than 10 percent of boron, not less than 0.05 percent and not more than 5 percent of copper and the rest that consists of iron and unavoidable impurities. Up to 20 percent of the iron contained is replaceable with cobalt. The alloy powders are made up of flat crystal grains having mean thickness h (the shortest measure), d not smaller than 0.01 μm and not larger than 0.5 μm and ratio d/h not smaller than 2, where d is the means measure of the grains taken at right angles to the widthwide direction thereof, and the alloy powders are magnetically anisotropic. Each rare-earth alloy anisotropic powder is prepared by melting an R-Fe-B-Cu alloy, putting thin ribbons prepared by quenching the melt or a powder prepared by grinding the thin ribbons in a metal container, hermetically sealing the metal container after replacing its inner atmosphere with a vacuum or an inert gas atmosphere, and rolling the thin ribbons or powder, together with the metal container, at a temperature not lower than 500° C. and not higher than 900° C. Rare-earth alloy anisotropic magnets are made by kneading and forming the rare-earth alloy anisotropic powders with not less than 10 percent and not more than 50 percent by volume of resin or by hot-compressing the rare-earth alloy anisotropic powders.

18 Claims, 4 Drawing Sheets

WITH COPPER ADDITION 0.2 μm

WITHOUT COPPER ADDITION 0.2 μm

RARE-EARTH ANTISOTROPIC POWDERS AND MAGNETS AND THEIR MANUFACTURING PROCESSES

This application is a continuation of application Ser. No. 07/475,460 filed Feb. 6, 1990, now abandoned.

BACKGROUND OF THE INVENTION

1. Field of the Invention

This invention relates to rare-earth anisotropic powders and magnets consisting essentially of Fe-R-B alloys (R is at least one of neodymium and praseodymium or at least one of them and one or more other rare-earth elements) and their manufacturing processes.

2. Description of the Prior Art

Recently developed rare-earth-and-iron-based anisotropic magnets having excellent magnetic properties can be divided into the following three categories according to their manufacturing processes:

(1) A sintered anisotropic magnet made by forming, sintering and heat-treating a powder prepared by grinding a cast alloy to a fineness of the order of single crystals of approximately 3 μm and oriented in a magnetic field (Japanese Provisional Patent Publication No. 46008 of 1984).

(2) A bonded isotropic magnet made by forming a mixture of an isotropic powder, which is prepared by grinding flaky thin ribbons, approximately 20 to 30 μm in thickness, obtained by a melt quenching process, and a resin (Japanese Provisional Patent Publication No. 64739 of 1984); a bulked isotropic magnet made by hot-pressing an isotropic powder into a mass of high density and a bulked anisotropic magnet made by hot-upsetting the high-density bulked isotropic magnet (Japanese Provisional Patent Publication No. 100402 of 1985, IEEE Trans. Mag. Vol. MAG 21, No. 5 1985 (1985)); and a bonded anisotropic magnet made by forming in a magnetic field a mixture of an anisotropic powder, which is prepared by grinding the bulked anisotropic magnet, and a resin (Japanese Provisional Patent Publication No. 7504 of 1989).

(3) A bulked anisotropic magnet made by plastically deforming a cast ingot by hot upsetting or other processes (Japanese Provisional Patent Publications Nos. 203302 of 1987 and 704 of 1989).

Made of a powder ground to a fineness of the order of single crystals, the sintered anisotropic magnet (1) has highly-aligned magnetic domains, producing as great a magnetic strength as 35 to 45 MGOe in terms of maximum energy product. But its thermal stability is low because its crystal grain size is as large as about 10 μm and its coercive force depends on nucleation (i.e., the coercive force is determined when new reverse-domain walls appear from grain boundaries etc.). When the sintered anisotropic magnet is ground to a powder, the coercive force drops significantly under the influence of the oxidization and strain at the surface of the powder (Y. Nozawa et al. J. Appl. Phys. Vol. 64 No. 10 5285-5289 (1988)). Several methods heretofore proposed to suppress the post-grinding drop in the coercive force by changing the sintering conditions and applying heat treatment to the ground powder (C. R. Paik et al. IEEE Trans. Mag. Mag-23 No. 5 2512 (1987)), and other measures have not succeeded in solving problems of low magnetic properties, thermal stability and corrosion resistance.

The anisotropic magnet (3) too does not have good thermal stability because its crystal grain size and mechanism to provide coercive force are similar to those of the sintered anisotropic magnet (T. Shimoda et al. Proceeding of the Tenth International Workshop in Rare-Earth Magnets and Their Application, (1), 389 (1989)). This process is unsuitable for the making of anisotropic powders because grinding lowers magnetic properties.

In contrast, the anisotropic powder and magnet (2) maintain their magnetic properties even after grinding because their crystal grain size is fine and their coercive force depends on pinning (i.e., the coercive force is determined when domain walls at grain boundaries etc. move to other places getting out of position). As a result of the plastic deformation applied for the attainment of anisotropy, however, their crystal grains are flattened. Because the plastic deformation takes place at high temperatures, in addition, crystal grains grow larger to reduce absolute coercive force, while increasing its temperature coefficient to −0.60%/°C. As a consequence, the irreversible loss of magnetic flux becomes as great as about −30% after heat-treated at 140° C. (when permeance coefficient = −2) and the magnet becomes no longer suited for practical use. Here the irreversible loss of magnetic flux means the fraction by which the magnetic flux of a specimen magnetized at room temperature, heated to a given temperature and kept at that temperature for a given time, decreases when it is cooled to room, temperature.

A technology to improve thermal stability by adding gallium, Ga, to R-Fe-(Co)-B alloys was disclosed (Japanese Provisional Patent Publication No. 7504 of 1989). But the addition of gallium improves thermal stability by increasing intrinsic coercive force to between 19 and 21 kOe. Magnetizability decreases with increasing coercive force. Being much more expensive than neodymium, Nd, etc., in addition, gallium raises the total material cost. Thus, gallium is not practically preferable additive.

The manufacturing processes of anisotropic magnets disclosed in Japanese Provisional Patent Publication Nos. 100402 of 1985 and 7504 of 1989 grind flaky thin ribbons, ranging between approximately 20 and 30 μm in thickness, obtained by a melt quenching process. The obtained powder is compacted by hot pressing and then formed into bulked anisotropic magnets by hot-upsetting. These processes are complicated. Because final shapes are difficult to obtain by upsetting, in addition, formed pieces must be cut or ground and polished into the desired shape. The process to grind an upset anisotropic magnet into an anisotropic powder too is complicated and unsuited for mass production. To eliminate the shortcomings of these processes, the inventor et al. invented a simple process for manufacturing anisotropic powders that is suited for mass production (Japanese Patent Application No. 256550 of 1988).

Japanese Provisional Patent Publication No. 39702 of 1989 discloses a process for making anisotropic magnets by subjecting powders of R-Fe-B-Cu-M alloys (M is at least one element chosen from the group of zirconium, niobium, molybdenum, hafnium, tantalum and tungsten) obtained by a melt quenching process to hot plastic working. With the content of R limited to 12 atomic percent or under, the process improves plastic workability by taking advantage of the effect of copper. Because the presence of zirconium or niobium is indispensable, however, plastic deformation and anisotropy are difficult to occur if R is kept more than 12 atomic percent.

As is obvious from the above, the conventional rare-earth-iron-based anisotropic magnets involve many problems. Because of the poor thermal stability, for example, they are unsuited for such applications as motors used at high temperatures. Even is their thermal stability is improved by addition of gallium, their magnetzability is impaired through an increase in their intrinsic coercive force. Besides, expensive gallium raises the total material cost. And their manufacturing processes are complicated.

SUMMARY OF THE INVENTION

The object of this invention is to provide rare-earth-and-iron-based anisotropic magnets containing over 12 atomic percent of one or more rare-earth elements providing high coercive force and having excellent magnetizability and improved temperature coefficient of coercive force and thermal stability and anisotropic powders for use in their making and processes for manufacturing such anisotropic magnets and powders.

Any of rare-earth anisotropic powders according to this invention consists of over 12 percent and not more than 20 percent of R (R is at least one of neodymium and praseodymium or at least one of them and one or more rare-earth elements), not less than 4 percent and not more than 10 percent of boron, not less than 0.05 percent and not more than 5 percent of copper, with iron and unavoidable impurities accounting for the rest (the percentages used in this specification are all in terms of atomic percent). Up to 20 percent of iron is replaceable with cobalt. The crystal grains making up the alloy powders are flat. If the mean thickness of the crystal grains is h, then the mean measure of the crystal grains d perpendicular to the widthwise direction is not less than 0.01 μm and not more than 0.5 μm, with the ratio d/h being not smaller than 2. The individual particles of the powders are magnetically anisotropic. Their residual magnetic flux density in the direction of the axis of easy magnetization is not lower than 9 kG. The anisotropic powders according to this invention have improved temperature coefficient of coercive force and excellent thermal stability.

The rare-earth anisotropic powders of this invention are prepared by the following process.

Thin ribbons of permanent magnet prepared by quenching a melt of R-Fe-B-Cu alloy or a powder prepared by grinding the thin ribbons is subjected to plastic working. The thin ribbons or powder is put in a metal container that is then hermetically sealed after its inside atmosphere has been either evacuated or replaced with an inert gas atmosphere. Then, the thin ribbons or powder is rolled, together with the container, at a temperature not lower than 500° C. and not higher than 900° C. If required, a heat treatment to control intrinsic coercive force is applied at a temperature not lower than 400° C. and not higher than 800° C.

Bonded rare-earth anisotropic magnets according to this invention are made by kneading and forming mixtures of the rare-earth anisotropic powders thus prepared with a resin that is between not less than 10 percent and not more than 50 percent by volume. Or, otherwise, high-density anisotropic magnets close to the desired finished shape are made by hot-compressing the rare-earth anisotropic powders.

Having low irreversible loss of magnetic flux and high thermal stability, the copper-added anisotropic powders or anisotropic magnets made therefrom according to this invention can be used even at relatively high temperatures. Besides, the magnet-making processes according to this invention are simpler than conventional and, therefore, higher in commercial applicability.

DESCRIPTION OF THE PREFERRED EMBODIMENTS

Figure 1:
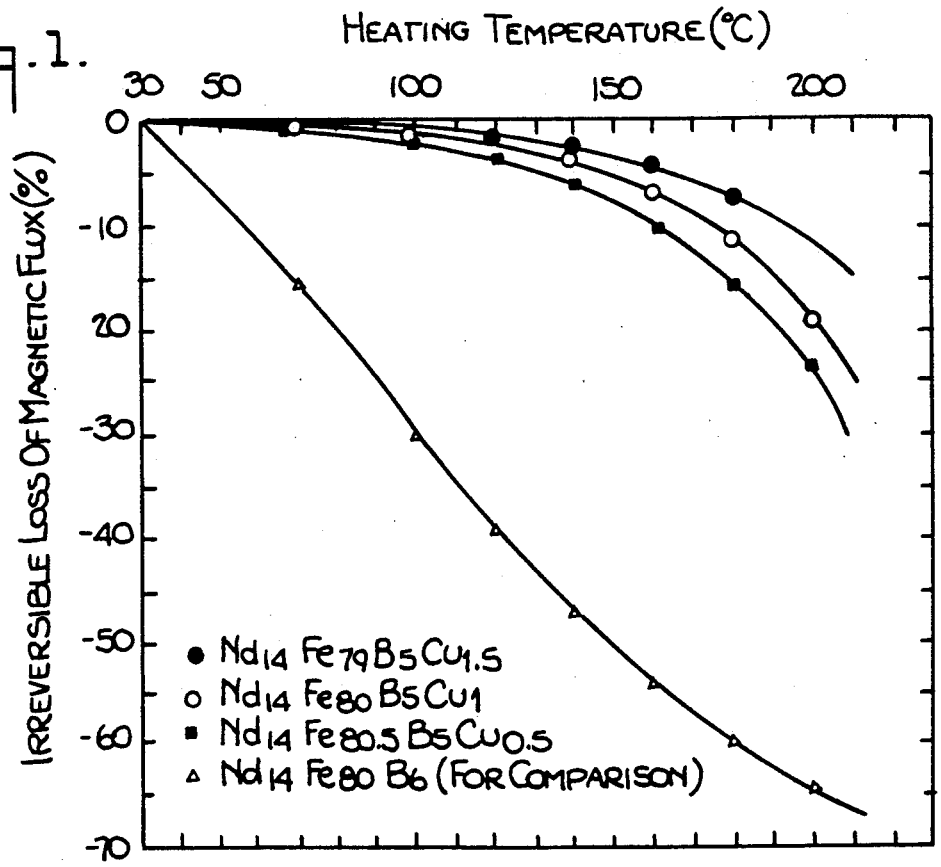
FIG. 1 is a graph plotting the irreversible loss of magnetic flux of high-density anisotropic magnets having compositions of $Nd_{14}Fe_{80.5}B_5Cu_{0.5}$, $Nd_{14}Fe_{80}B_5Cu_1$, $Nd_{14}Fe_{79.5}B_5Cu_{1.5}$ and $Nd_{14}Fe_{80}B_6$ alloys.

The R-Fe-B-Cu alloy powders according to this invention are magnet alloys consisting essentially of $R_2Fe_{14}B_1$ tetragonal compounds whose c-axis is the easy magnetization direction. The alloy powders of this invention are made anisotropic by plastic working. The crystal grains are flat and their c-axis is preferentially oriented in the widthwise direction. If the mean measure d of the crystal grains perpendicular to the widthwise direction exceeds 0.5 μm, intrinsic coercive force drops to impair the squareness of the demagnetizing curve. Intrinsic coercive force drops also when the mean measure d becomes smaller than 0.01 μm, with magnetic properties approaching those of noncrystalline substances. Therefore, the means measure d of the crystal grains must be kept between not smaller than 0.01 μm and not larger than 0.5 μm. Furthermore, the ratio d/h (h is the mean thickness of the crystal grains) representing the degree of flatness of the crystal grains must be not smaller than 2 because satisfactory anisotropy and high enough residual magnetic flux density are unobtainable when the ratio becomes smaller than 2.

The reasons for limiting the composition of the anisotropic powders are discussed in the following.

R consists of at least one of neodymium and praseodymium, or a combination of at least one of them and one or more other rare-earth elements. R must contain at least one of neodymium and praseodymium because they provide particularly excellent magnetic properties when contained in $R_2Fe_{14}B_1$-based tetragonal compounds. Preferably, the sum of neodymium and praseodymium should account for 50 percent or over of the total amount of R. More preferably, neodymium should account for 90 percent or over of the total amount of R. If the content of R is 12 percent or less, plastic deformation does not easily occur in the compounds of this invention, thereby making it difficult to attain the desired anisotropy. If R is over 20 percent, the residual magnetic flux density drops. This is the reason why the content of R is limited between over 12 percent and not higher than 20 percent.

If boron content is under 4 percent, $R_2Fe_{14}B_1$-based tetragonal compounds are not formed satisfactorily, as a result of which high enough intrinsic coercive force and residual magnetic flux density are not attained. If boron content exceeds 10 percent, residual magentic flux density drops. This is the reason why boron content is limited between not lower than 4 percent and not higher than 10 percent.

The inventor found that copper refines the size of crystal grains and improves thermal stability. If copper content is under 0.05 percent, however, sufficient crystal grain refinement and thermal stability improvement are unattainable. If copper content exceeds 5 percent, on the other hand, residual magnetic flux density drops. Thus copper content is limited between not lower than 0.05 percent and not higher than 5 percent. Preferably, copper content should be between not lower than 0.2 percent and not higher than 3 percent.

Addition of cobalt raises the Curie temperature. But if cobalt substitutes for over 20 percent of iron, residual magnetic flux density drops. Therefore, addition of cobalt is limited to not more than 20 percent of iron content.

The rest is iron and unavoidable impurities.

If the mean grain size d is between not smaller than 0.01 μm and not larger than 0.5 μm, better magnetic properties are obtained as the ratio d/h representing the degree of flatness of crystal grains increases. Among alloys of the same composition, the mean grain size d and the flatness ratio d/h can be varied by varying the rolling temperature and the rolling reduction in thickness. If the rolling temperature and the rolling reduction in thickness are fixed, on the other hand, the mean grain size d and the flatness ratio d/h can be varied by varying the composition of alloys. The ratio d/h depends on the rolling conditions and the composition of alloys. It is preferable to increase the ratio d/h within the allowable limits of the rolling conditions and alloy composition.

An anisotropic powder is a powder in which higher residual magnetic flux density and higher squareness of the 4 π I-H curve in the second quadrant are obtained in the direction parallel to the axis of easy magnetization than in the direction perpendicular thereto. The residual magnetic flux density obtained by hot-compressing an isotropic powder is usually 7.5 to 8.0 kG. Anisotropic magnets having higher residual magnetic flux and maximum energy product than isotropic magnets can be made by using R-Fe-B-Cu-based anisotropic powders of this invention whose residual magnetic flux density is 9 kG of higher. Residual magnetic flux density increases as the flatness ratio d/h increases.

The anisotropic powders just mentioned are obtained by subjecting isotropic powders, which are prepared by quenching the melt of Nd(Pr)-Fe-B-Cu alloys, to plastic deformation at temperatures between not lower than 500° C. and not higher than 900° C.

Usually quenching is performed by the single-roll process. But the twin-roll process or the gas atomizing process are also applicable. The single-roll process produces flaky thin ribbons ranging between 20 and 30 μm in thickness, 1 and 2 mm in width and 10 and 30 mm in length. Here, quenching means cooling that is performed at such a rate as to produce fine crystal grains whose mean size d is not larger than 0.5 μm.

Plastic deformation is achieved by as follows. The flaky thin ribbons obtained by quenching are ground. The ground powder is compacted by not pressing, hot isostatic pressing or other methods and then subjected to hot upsetting. The obtained product is a bulked anisotropic magnet, which is then ground into an anisotropic powder. For mass production plastic deformation can be achieved by putting the flaky thin ribbons made by quenching or the powder prepared therefrom in a metal container, which is then hermetically sealed after the inside atmosphere has been either evacuated or replaced with an inert gas atmosphere. Then, the thin ribbons or powders is rolled, together with the container, at a temperature not lower than 500° C. and not higher than 900° C. The metal container constrains the motion of the thin ribbons or ground powder when an external stress to cause plastic deformation works thereon. The shearing stress to cause plastic deformation works effectively on the constrained powder. The alloys used in this invention are so oxidizable that they must be placed in a vacuum or an inert gas atmosphere when they are heated to high temperatures. With this invention, this requirement is easily fulfilled by simply hermetically sealing the metal container after its inside atmosphere has been either evacuated or replaced with an inert gas atmosphere. If the rolling temperature is lower than 500° C., resistance to deformation is too large to cause the desired plastic deformation and, therefore, the desired orientation along the axis of easy magnetization. If the rolling temperature is higher than 900° C., on the other hand, crystal grains coarsen to lower the intrinsic coercive force. Thus the rolling temperature is limited between not lower than 500° C. and not higher than 900° C.

The higher the density of the contents in the metal container, the greater is the effectiveness with which plastic deformation within said temperature range of not lower than 500° C. and not higher than 900° C. is achieved.

The effectiveness can be increased by increasing the density of the contents by applying preliminary plastic working at a temperature lower than 800° C. before the plastic deformation within the temperature range of not lower than 500° C. and not higher than 900° C. The temperature of the preliminary plastic working is limited to below 800° C. because grain coarsening detrimental to the plastic working within the 500°-900° C. temperature range occurs above that temperature limit. The lower limit of the preliminary plastic working is room temperature.

The same effect can be achieved by preliminary forming, as well. Preliminary forming increases the density of the thin ribbons or the powder prepared by grinding the thin ribbons by applying cold pressing when they are packed into a metal container. The density of the powder packed without applying additional pressure is approximately 2.8 to 2.9 g/cm$^3$. The density at 100 percent is 7.5 g/cm$^3$. The preliminary forming increases the packing density of the powder to approximately 2.9 to 6.0 g/cm$^3$, thereby increasing rolling efficiency.

To obtain an anisotropic powder having excellent mangetic properties, it is necessary to roll thin ribbons or a powder prepared therefrom with a thickness reduction of 40 percent or above. The packing density of thin ribbons or a powder prepared therefrom in a metal container and the applicable rolling reduction are determined as described in the following.

The density in a metal container containing thin ribbons or a powder prepared therefrom is a mean density of the thin ribbons or powder plus the clearance left unfilled. When the container packed with the thin ribbons or powder is rolled, plastic deformation of the thin ribbons or powder occurs after the clearance has been crushed preferentially. Therefore, the rolling reduction is determined by adding the reduction needed to attain a given packing density by crushing the clearance to the reduction with which the thin ribbons or powder is to be rolled.

Anisotropic magnets made by the rolling process can be thoroughly bulked. Usually, however, they contain particles of various sizes. Therefore, they are screened to obtain powders of desired particle sizes or, otherwise, ground in a disk mill, Braun mill, ball mill, Attoritor mill, etc. If the mean size of the obtained powder is smaller than 10 μm, intrinsic coercive force drops. Also, the danger of ignition and other problems appear, thereby impairing the ease of handling. If the mean size of the powder exceeds 1500 μm, it becomes difficult to form thinner magnets. Thus, the means size of the powder should preferably be between 10 and 1500 μm.

Heat treatment increases the intrinsic coercive force of the anisotropic powders of this invention whose anisotropy is obtained by plastic working. The heat treatment temperature is limited between not lower than 400° C. and not higher than 800° C. because intrinsic coercive force does not increase under 400° C., whereas crystal grains coarsen, the squareness of the demagnetization curve decreases and the residual magnetic flux density and maximum energy product decrease above 800° C. The anisotropic powders of this invention can be used without heat treatment, too.

A thermally stable bonded anisotropic magnet is obtained by kneading together and anisotropic powder of this invention with a thermosetting resin, compressing the mixture into a desired shape in a magnetic field, and allowing the resin to solidify. Also, a thermally stable bonded anisotropic magnet is obtained by kneading together an anisotropic powder of this invention with a thermoplastic resin and forming the mixture into a desired shape in a magnetic field by injection molding. The anisotropic powders of this invention can be hot-formed into anisotropic magnets of so-called "near-net shapes" without using resin binders. The anisotropic magnets not containing resin binders have higher residual magnetic flux densities than those containing them.

The particles of the anisotropic powders according to this invention are flaky, with the axis of easy magnetization oriented in the widthwise direction of the flakes. Therefore, adjoining flakes of an anisotropic powder can be aligned substantially parallel to one another by mechanical orientation in forming, without putting them in a magnetic field. The obtained anisotropic magnets have excellent magnetic properties in the compressing direction.

Some examples of the anisotropic powders and magnets according to this invention are given below.

EXAMPLE 1

A mixture of neodymium, electrolytic iron, boron and electrolytic copper, each having a purity of 99.9 percent, was melted by high-frequency heating in argon. By ejecting the melt onto a water-cooled copper roll rotating at a high surface speed of 25 m per second, flaky thin ribbons ranging from 1 to 2 mm in width, 10 to 30 mm in length and 20 to 30 μm in thickness were obtained. On analysis, the thin ribbons proved to have chemical compositions that can be expressed as $Nd_{14}Fe_{80.5}B_5Cu_{0.5}$, $Nd_{14}Fe_{80}B_5Cu_1$ and $Nd_{14}Fe_{79.5}B_5Cu_{1.5}$ in atomic percent. For purpose of comparison, a specimen with a composition of $Nd_{14}Fe_{80}B_6$ was also prepared. All of them were ground to 350 μm and under. The powders were put in steel pipes, which were then hermetically sealed after evacuating their inside to a vacuum of $10^{-3}$ to $10^{-4}$ torr. The pipes containing the powders were rolled at a temperature of 700° C. so that the rolled powders would be subjected to the reduction of 80 percent in thickness. The rolled specimens were water-cooled.

The obtained anisotropic powders were ground to 500 μm and under and formed into shape by hot pressing, without placing them in a magnetic field. Hot pressing was done at a temperature of 700° C. with a pressure of 1 ton/cm$^2$. After magnetizing in a magnetic field of 60 kOe, magnetic properties of the individual specimens were determined using an automatic fluxmeter.

Table 1 shows the results obtained.

TABLE 1

| | Intrinsic Coercive Force iHc (kOe) | Residual Magnetic Flux Density Br (kG) | Maximun Energy Product $(BH)_{max}$ (MGOe) | Density (ρg/cm$^3$) |
|---|---|---|---|---|
| $Nd_{14}Fe_{80.5}B_5Cu_{0.5}$ | 14.7 | 9.3 | 17.9 | 7.5 |
| $Nd_{14}Fe_{80}B_5Cu_1$ | 16.1 | 9.5 | 20.1 | 7.5 |
| $Nd_{14}Fe_{79.5}B_5Cu_{1.5}$ | 16.4 | 9.0 | 17.1 | 7.5 |
| $Nd_{14}Fe_{80}B_6$ (For Comparison) | 8.3 | 9.7 | 20.4 | 7.5 |

To determine the thermal stability of the anisotropic magnets, their specimens, 10 mm in diameter and 7 mm high (permeance coefficient = −2), were magnetized in a magnetic field of 60 kOe at room temperature, kept at temperatures of 30° C. to 200° C. for 30 minutes. After cooling back to 30° C., their magnetic flux was measured by a drawing method. The results of the irreversible loss of magnetic flux for each heating temperature are shown in FIG. 1.

As is obvious from FIG. 1, addition of copper improved thermal stability.

Then, thin specimens parallel to the hot-pressing direction were cut out from the specimens shown in Table 1. The structure of the specimens were observed under a transmission electron microscope from the direction perpendicular to the compressing direction.

Figure 2A:
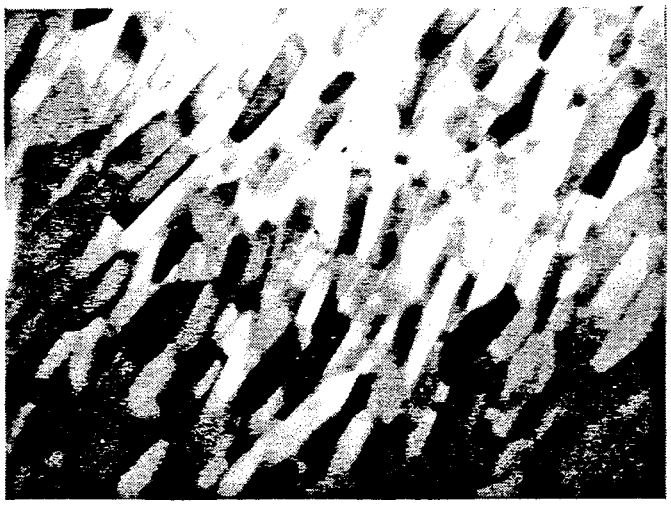
FIG. 2 shows transmission electron micrographs of the high-density anisotropic magnets of $Nd_{14}Fe_{80}B_5Cu_1$ and $Nd_{14}Fe_{80}B_6$ alloys in FIG. 1 at (*a*) and (*b*)
Figure 2B:
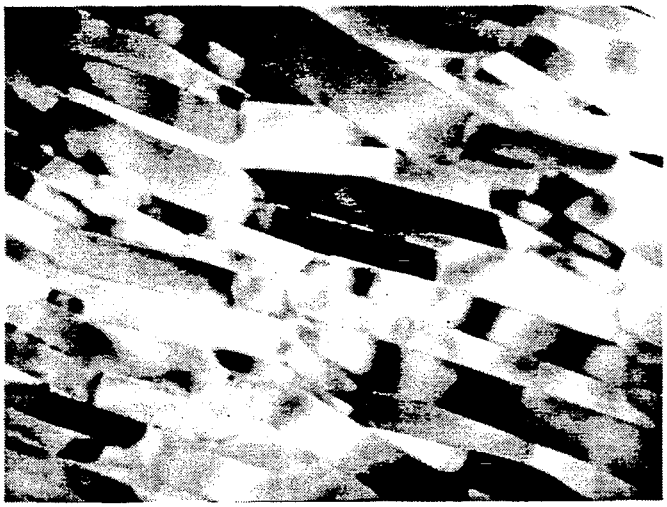

Table 2 shows the size and flatness ratio of their crystal grains. FIG. 2 shows the structures of the specimens of the $Nd_{14}Fe_{80}B_5Cu_1$ and $Nd_{14}Fe_{80}B_6$ (for comparison) alloys at (a) and (b).

TABLE 2

| | Size of Crystal Grains d (μm) | Flatness Ratio of Crystal Grains d/h |
|---|---|---|
| $Nd_{14}Fe_{80.5}B_5Cu_{0.5}$ | 0.18 | 3.9 |
| $Nd_{14}Fe_{80}B_5Cu_1$ | 0.13 | 4.3 |
| $Nd_{14}Fe_{79.5}B_5Cu_{1.5}$ | 0.09 | 4.1 |
| $Nd_{14}Fe_{80}B_6$ (For Comparison) | 0.60 | 6.1 |

Addition of copper proved to have refined the size of crystal grains.

EXAMPLE 2

For the purpose of comparison, an anisotropic magnet having a composition of $Nd_{14}Fe_{79}B_6Ga_1$ in atomic percent was prepared in the same way as in Example 1. (Gallium used was of 99.99 percent purity.) The magnetic properties of the magnet were: intrinsic coercive force=18.3 kOe, residual magnetic flux density=9.7 kG, maximum energy product=21.3 MGOe, and density=7.5 g/cm$^3$. Thermal stability was determined by the same method as that used in Example 1.

Figure 3:
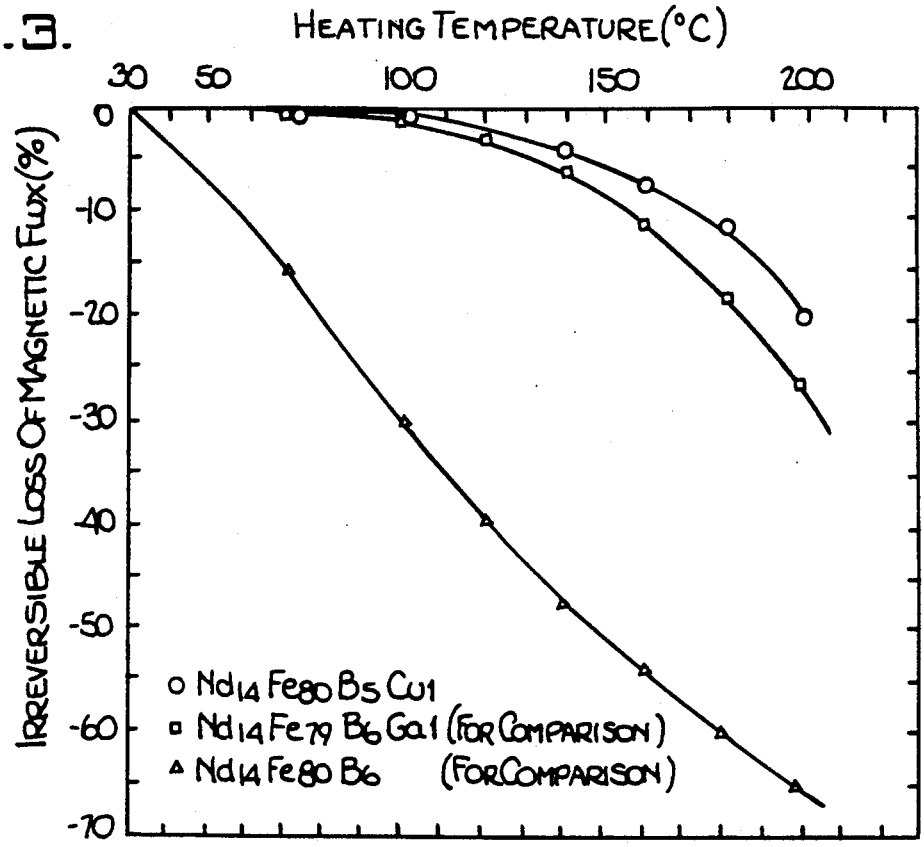
FIG. 3 is a graph plotting the irreversible loss of magnetic flux of high-density anisotropic magnets of $Nd_{14}Fe_{80}B_5Cu_1$, $Nd_{14}Fe_{79}B_6Ga_1$ and $Nd_{14}Fe_{80}B_6$ alloys.

FIG. 3 shows the obtained results, together with the results with the $Nd_{14}Fe_{80}B_5Cu_1$ and $Nd_{14}Fe_{80}B_6$ alloys obtained in Example 1.

As is obvious from FIG. 3, addition of copper provided higher thermal stability than that of gallium.

EXAMPLE 3

An anisotropic powder having a composition of $Nd_{14}Fe_{80}B_5Cu_1$ in atomic percent was prepared in the same way as in Example 1. Rolling was performed at temperatures ranging from 400° C. to 1000° C. so that the rolled powder would be subjected to the reduction of 80 percent in thickness.

Magnetic properties of the anisotropic powder were measured with a vibrating sample magnetometer. The specimen was prepared by grinding the rolled product to 150 μm and under, putting the obtained powder, together with epoxy resin, in a container having an inside diameter of 6 mm and a height of 2 mm, and orienting the specimen in a magnetic field of 25 kOe. The packing density of the specimen was approximately 1.1 g/cm$^3$. The results of measurement were obtained by converting the density of the specimen to 7.5 g/cm$^3$. Before doing measurement, the specimen was subjected to pulse magnetization at 60 kOe. In making measurement with a vibrating sample magnetometer, correction according to the shape of the sample to be measured is usually needed. But the required demagnetizing correction was not made because the sample was a powder. Thus, the values of intrinsic coercive force were true, but those of residual magnetic flux density and maximum energy product were slightly lower than the true values.

The results are shown in Table 3.

TABLE 3

| Rolling Temperature (°C.) | Intrinsic Coercive Force iHc (kOe) | Residual Magnetic Flux Density Br (kG) | Maximun Energy Product $(BH)_{max}$ (MGOe) |
|---|---|---|---|
| Before Rolling | 19.0 | 7.7 | 13.9 |
| 400 | 19.0 | 7.7 | 13.8 |
| 500 | 17.3 | 9.1 | 19.3 |
| 600 | 15.6 | 10.4 | 24.2 |
| 700 | 14.3 | 11.1 | 27.4 |
| 800 | 13.0 | 10.3 | 22.5 |
| 900 | 8.6 | 9.2 | 14.0 |
| 1000 | 4.0 | 6.2 | 2.3 |

As is obvious from Table 3, rolling at temperatures between 500° C. and 900° C. produced anisotropic powders with residual magnetic flux densities of 9 kG or over.

EXAMPLE 4

Neodymium, electrolytic iron, electrolytic cobalt, boron and electrolytic copper, each having a purity of 99.9 percent, were melted in argon to produce thin ribbons of the chemical compositions, expressed in atomic percent, shown in Table 4 in the same way as in Example 1. The specimen designated as $Nd_{11.7}Fe_{82.2}B_{5.1}Cu_{1.0}$ in Table 4 was prepared for the purpose of comparison. The thin ribbons were ground to 350 μm and under. The as-ground powders were put in steel pipes which were then hermetically sealed after evacuating their inside to a vacuum of $10^{-3}$ to $10^{-4}$ torr. The pipes containing the powders were rolled at a temperature of 700° C. so that the rolled powders would be subjected to the reduction of 80 percent in thickness. The rolled specimens were water-cooled.

Magnetic properties of the obtained anisotropic powders were measured using a vibrating sample magnetometer as in Example 3. Table 4 shows the obtained results.

TABLE 4

| | Intrinsic Coercive Force iHc (kOe) | Residual Magnetic Flux Density Br (kG) | Maximun Energy Product $(BH)_{max}$ (MGOe) |
|---|---|---|---|
| $Nd_{11.7}Fe_{82.2}B_{5.1}Cu_{1.0}$ (For Comparison) | 6.5 | 8.9 | 13.8 |
| $Nd_{12.6}Fe_{81.3}B_{5.1}Cu_{1.0}$ | 8.6 | 10.2 | 20.1 |
| $Nd_{13.2}Fe_{80.3}B_{5.5}Cu_{1.0}$ | 8.5 | 10.5 | 21.1 |
| $Nd_{13.5}Fe_{80.0}B_{5.5}Cu_{1.0}$ | 10.5 | 10.7 | 24.5 |
| $Nd_{13.6}Fe_{80.3}B_{5.1}Cu_{1.0}$ | 10.5 | 10.7 | 24.0 |
| $Nd_{13.7}Fe_{79.7}B_{5.6}Cu_{1.0}$ | 12.3 | 10.5 | 24.3 |
| $Nd_{13.8}Fe_{79.9}B_{5.3}Cu_{1.0}$ | 11.0 | 10.8 | 25.0 |
| $Nd_{13.9}Fe_{79.9}B_{5.2}Cu_{1.0}$ | 14.3 | 10.9 | 27.3 |
| $Nd_{14.1}Fe_{80.5}B_{4.4}Cu_{1.0}$ | 15.5 | 9.7 | 18.3 |
| $Nd_{14.1}Fe_{79.5}B_{5.4}Cu_{1.0}$ | 14.7 | 10.8 | 26.5 |
| $Nd_{14.1}Fe_{78.9}B_{6.0}Cu_{1.0}$ | 14.3 | 10.3 | 24.0 |
| $Nd_{14.2}Fe_{79.5}B_{5.3}Cu_{1.0}$ | 14.0 | 11.0 | 27.5 |
| $Nd_{14.3}Fe_{79.7}B_{5.0}Cu_{1.0}$ | 14.5 | 10.6 | 25.0 |
| $Nd_{15.5}Fe_{78.4}B_{5.1}Cu_{1.0}$ | 16.0 | 10.1 | 22.7 |
| $Nd_{16.0}Fe_{78.0}B_{5.0}Cu_{1.0}$ | 17.0 | 9.6 | 21.0 |
| $Nd_{13.9}Fe_{80.7}B_{4.9}Cu_{0.5}$ | 12.0 | 10.9 | 27.0 |
| $Nd_{13.9}Fe_{79.8}B_{4.9}Cu_{1.4}$ | 13.0 | 10.7 | 26.0 |
| $Nd_{14.3}Fe_{79.1}B_{6.1}Cu_{0.5}$ | 15.2 | 10.5 | 24.7 |
| $Nd_{14.3}Fe_{78.4}B_{5.9}Cu_{1.4}$ | 12.9 | 10.0 | 22.5 |
| $Nd_{14.1}(Fe_{0.9}Co_{0.1})_{79.0}B_{5.9}Cu_{1.0}$ | 13.7 | 10.0 | 22.2 |

As is obvious from Table 4, residual magnetic flux density fell to an unsatisfactory level of under 9 kG when R (which was neodymium in Example 4) was not higher than 12 atomic percent.

The microstructure of the $Nd_{14.1}(Fe_{0.9}Co_{0.1})_{79.0}B_{5.9}Cu_{1.0}$ alloy was substantially the same as that shown in Table 2, with d and d/h standing at 0.14 m and 3.6, respectively.

EXAMPLE 5

Neodymium, praseodymium, electrolytic iron, boron and electrolytic copper, each having a purity of 99.9 percent, were melted in argon to produce thin ribbons having a composition of $Nd_{13.1}Pr_{0.8}Fe_{80.1}B_5Cu_1$ in atomic percent in the same way as in Example 1. The thin ribbons were ground to 350 μm and under. The obtained powder was (a) put as such in a steel pipe which was hermetically sealed after evacuating its inside to a vacuum of $10^{-3}$ to $10^{-4}$ torr (with the powder packed with a density of 2.9 g/cm$^3$), (b) formed under a pressure of 7 tons/cm$^2$ applied by a cold isostatic press to a density of 5.7 g/cm$^3$, with the formed piece being put in the same steel pipe as the one used in (a) which was then hermetically sealed after evacuating its inside to a vacuum of $10^{-3}$ to $10^{-4}$ torr (with the powder packed with a density of 5.7 g/cm$^3$), (c) treated in the same way as in (a), with an additional preliminary forming at 400° C. to obtain the packing density of 6.0 g/cm$^3$. The specimens thus prepared were rolled at 700° C. to the same thickness. The thickness reduction of the powders (a), (b) and (c) were 80 percent, 87 percent and 80 percent respectively. The rolled products were water-cooled.

Magnetic properties of the anisotropic powders thus obtained were measured with a vibrating sample magneto-meter as done in Example 3. Table 5 shows the obtained results.

TABLE 5

| | Intrinsic Coercive Force iHc (kOe) | Residual Magnetic Flux Density Br (kG) | Maximun Energy Product $(BH)_{max}$ (MGOe) |
|---|---|---|---|
| Process (a) | 14.1 | 11.0 | 27.2 |
| Process (b) | 13.4 | 11.5 | 30.1 |
| Process (c) | 14.0 | 11.2 | 27.5 |

The anisotropic products prepared by the different processes were ground to 590 μm and under. The obtained powders were subjected to preliminary forming by parallel-pressing (i.e. the pressing direction is parallel to the magnetic-field direction) in a magnetic field of approximately 10 kOe. The preformed products had a density of 4.3 g/cm$^3$. The preformed products were further hot-pressed until a higher density of 7.5 g/cm$^3$ was obtained. Hot pressing was performed at a temperature of 700° C. with a pressure of 1 ton/cm$^2$. After magnetization in a magnetic field of 60 kOe, magnetic properties of the heavily packed products were measured with an automatic fluxmeter. The results are shown in Table 6.

TABLE 6

| | Intrinsic Coercive Force iHc (kOe) | Residual Magnetic Flux Density Br (kG) | Maximun Energy Product $(BH)_{max}$ (MGOe) |
|---|---|---|---|
| Process (a) | 16.2 | 10.2 | 22.6 |
| Process (b) | 15.4 | 10.6 | 25.1 |
| Process (c) | 16.0 | 10.3 | 23.1 |

EXAMPLE 6

Anisotropic powders having compositions of $Nd_{14}Fe_{80}B_5Cu_1$, $Nd_{14}(Fe_{0.9}Co_{0.1})_{80}B_5Cu_1$ and $Nd_{14}Fe_{80}B_6$ in atomic percent were prepared in the same way as in Example 1. The rolling temperature was 700° C. The obtained anisotropic products were ground to between 150 and 250 μm. The powders were kneaded with 3 percent by weight (or approximately 20 percent by volume) of epoxy resin. The obtained mextures were then formed by parallel-pressing in a magnetic field of approximately 10 kOe. The formed products were then made into bonded anisotropic magnets by allowing the resin to solidify by holding at a temperature of 150° C. for 2 hours. After magnetization in a magnetic field of 60 kOe, magnetic properties of the individual magnets were measured with an automatic fluxmeter. The results are shown in Table 7.

TABLE 7

| | Intrinsic Coercive Force iHc (kOe) | Residual Magnetic Flux Density Br (kG) | Maximun Energy Product $(BH)_{max}$ (MGOe) | Density (ρg/cm$^3$) |
|---|---|---|---|---|
| $Nd_{14}Fe_{80}B_5Cu_1$ | 14.3 | 7.4 | 12.4 | 6.0 |
| $Nd_{14}(Fe_{0.9}Co_{0.1})_{80}B_5Cu_1$ | 15.0 | 7.3 | 12.0 | 6.1 |
| $Nd_{14}Fe_{80}B_6$ (For Comparison) | 13.2 | 7.2 | 11.3 | 5.8 |

The thermal stability of the bonded magnets was determined in the same way as in Example 1. The results are shown in FIG. 4.

Figure 4:
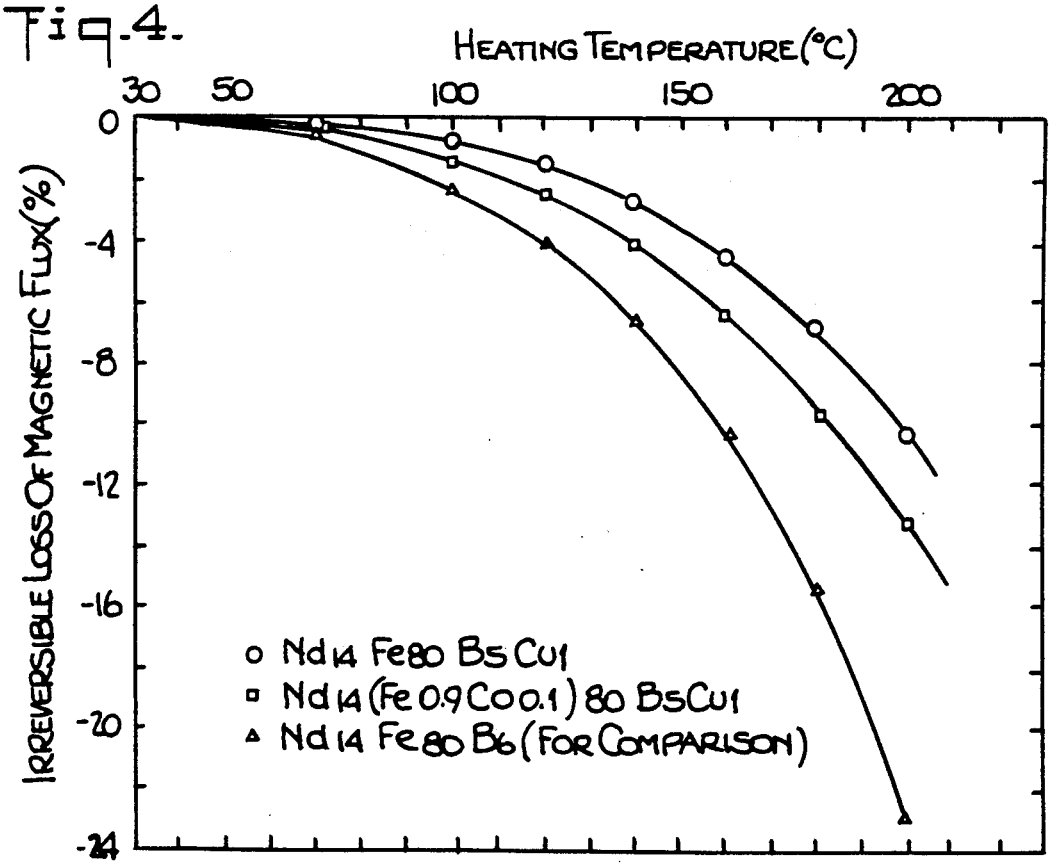
FIG. 4 is a graph plotting the irreversible magnetic flux loss of bonded anisotropic magnets of $Nd_{14}Fe_{80}B_5Cu_1$, $Nd_{14}(Fe_{0.9}Co_{0.1})_{80}B_5Cu_1$ and $Nd_{14}Fe_{80}B_6$ alloys.

As is obvious from FIG. 4, addition of copper improved thermal stability.

EXAMPLE 7

Anisotropic powders having compositions of $Nd_{14}Fe_{79}B_6Cu_1$ and $Nd_{14}Fe_{80}B_6$ in atomic percent were prepared in the same way as in Example 1. The rolling temperature was 700° C. After heat-treating at temperature of 300° C. to 800° C. for 15 minutes, changes in the intrinsic coercive force of the obtained anisotropic powders were measured. The results are shown in FIG. 5.

Figure 5:
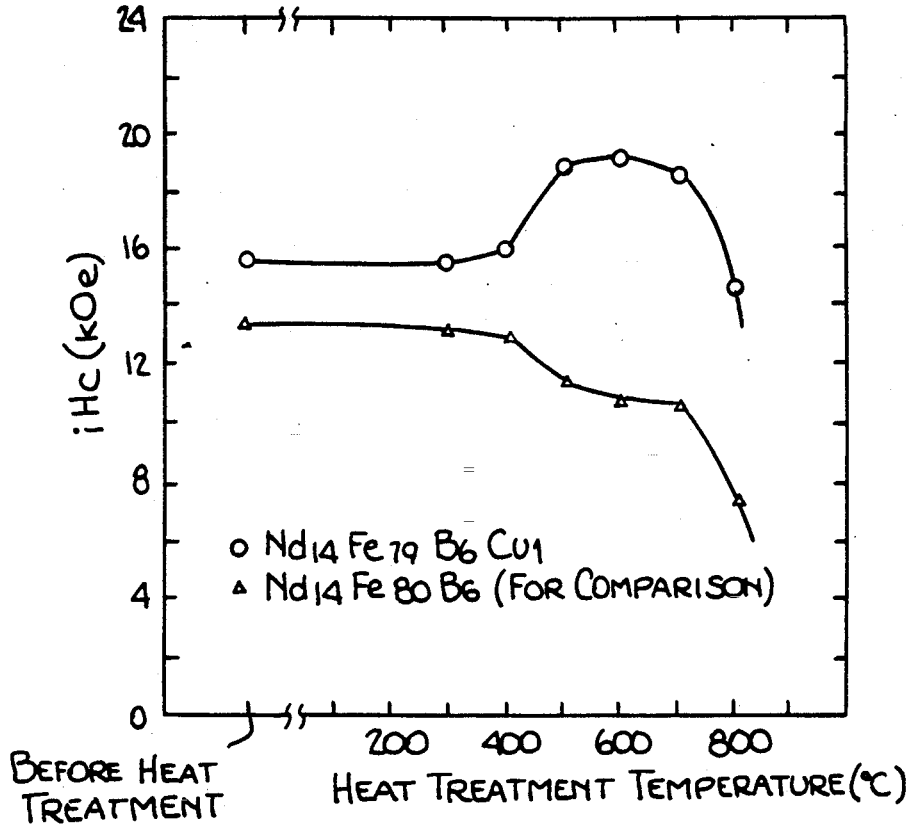
FIG. 5 shows the relationship between the heat treatment temperature and intrinsic coercive force of anisotropic powders of $Nd_{14}Fe_{79}B_6Cu_1$ and $Nd_{14}Fe_{80}B_6$ alloys.

The same intrinsic coercive forces as those shown in FIG. 5 were obtained with the rolled products that were heat-treated as-rolled, without grinding.

As is obvious from FIG. 5, the coercive force of the anisotropic powder having a composition of $Nd_{14}Fe_{80}B_6$ monotonically dropped when the powder was heat treated at a temperature of not lower than 400° C. In contrast, heat treatment between not lower than 400° C. and not higher than 800° C. increased the intrinsic coercive force of the anisotropic powder having a composition of $Nd_{14}Fe_{79}B_6Cu_1$. Thus, addition of copper proved to be capable of controlling the intrinsic coercive force of anisotropic powders.

EXAMPLE 8

An anisotropic powder having a composition $Nd_{14}Fe_{80}B_5Cu_1$ in atomic percent was prepared in the same way as in Example 1. After further grinding to between 150 and 250 μm and applying a heat treatment at 700° C. for 15 minutes, the powder was made into a bonded anisotropic magnet with a density of 6.0 g/cm$^3$ in the same way as in Example 6. Magnetic properties of the bonded anisotropic magnet magnetized in a magnetic field of 60 kOe were measured with an automatic fluxmeter. The intrinsic coercive force, residual magnetic flux density and maximum energy product were 16.3 kOe, 7.3 kG and 12.3 MGOe, respectively.

Also, the rolled product was heat treated before grinding. The heat-treated product was ground into a powder which was then made into a bonded anisotropic magnet. The bonded anisotropic magnet made by this method also exhibited similar magnetic properties.

EXAMPLE 9

The temperature dependence of the intrinsic coercive force of the anisotropic magnets with compositions of $Nd_{14}Fe_{80}B_5Cu_1$, $Nd_{14}Fe_{80}B_6$ and $Nd_{14}Fe_{79}B_6Ga_1$ made in Examples 1 and 2 was determined. Needle-like specimens (anisotropic in the lengthwise direction), 0.8 mm square in cross-section and 5 mm long, were heated to temperatures between 25° C. and 200° C. and magnetized in a magnetic field of 14 kOe at the individual temperatures in the positive (+) direction. The intrinsic coercive force of each specimen at each temperature was measured. Before heating, each specimen was magnetized in a magnetic field of 60 kOe at room temperature.

Figure 6:
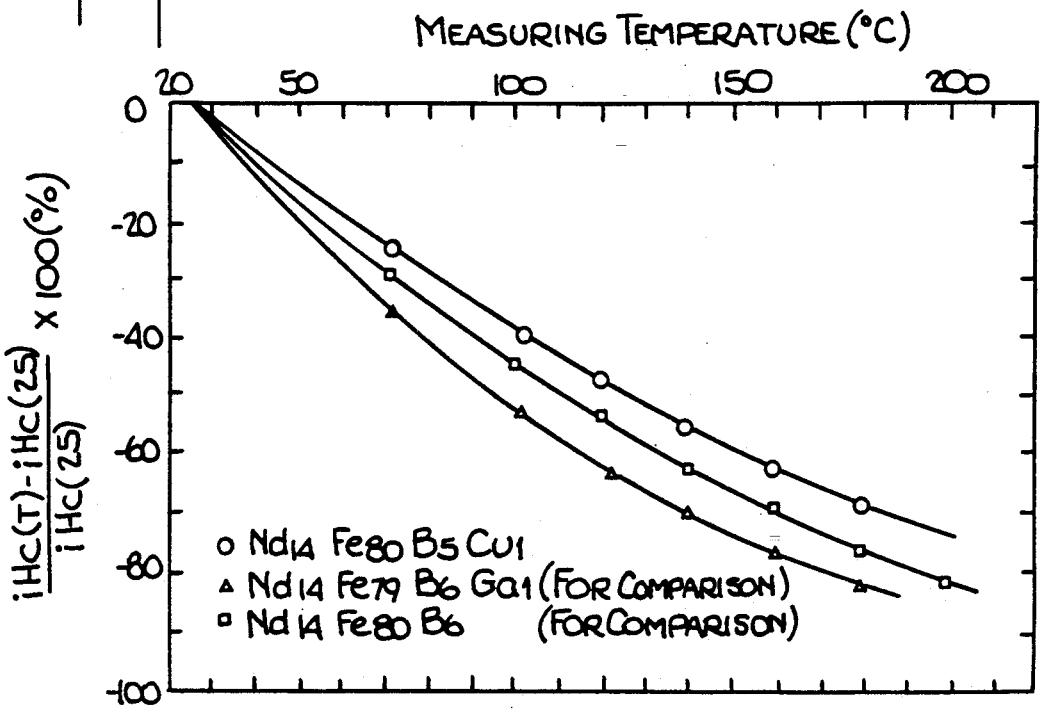
FIG. 6 is a graph plotting changes with temperature in the intrinsic coercive force of high-density anisotropic magnets of the $Nd_{14}Fe_{80}B_5Cu_1$, $Nd_{14}Fe_{79}B_6Ga_1$ and $Nd_{14}Fe_{80}B_6$ alloys shown in FIGS. 1 and 3.

The results are shown in FIG. 6.

Table 8 shows the temperature coefficients of intrinsic coercive force at temperatures between 25° C. and 140° C. derived from FIG. 6. Obviously, addition of copper improved the temperature coefficient of intrinsic coercive force.

TABLE 8

| | Temperature Coefficient of Intrinsic Coercive Force (%/°C.) |
|---|---|
| $Nd_{14}Fe_{80}B_5Cu_1$ | −0.48 |
| $Nd_{14}Fe_{79}B_6Ca_1$ (For Comparison) | −0.53 |
| $Nd_{14}Fe_{80}B_6$ (For Comparison) | −0.60 |

EXAMPLE 10

Anisotropic powders with compositions of $Nd_{14}Fe_{79}B_6Cu_1$ and $Nd_{14}Fe_{79}B_6Ga_1$ in atomic percent were prepared in the same way as in Example 1. The obtained anisotropic powders were ground to 150 to 250 μm, kneaded with 3 percent by weight (or approximately 20 percent by volume) of epoxy resin, and formed by parallel-pressing in a magnetic field of approximately 10 kOe. With the epoxy resin allowed to solidify by holding at 150° C. for 2 hours, the formed products were made into bonded anisotropic magnets. The $Nd_{14}Fe_{79}B_6Cu_1$ and $Nd_{14}Fe_{79}B_6Ga_1$ magnets magnetized in a magnetic field of 60 kOe exhibited intrinsic coercive forces of 15.6 kOe and 19.9 kOe, respectively.

Figure 7:
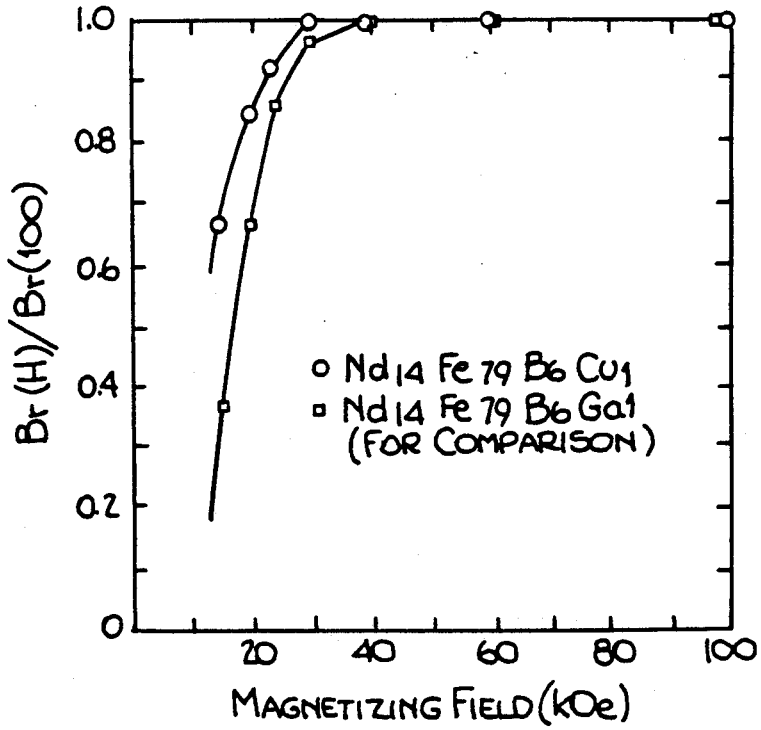
FIG. 7 is a diagram comparing the magnetizability of bonded anisotropic magnets of $Nd_{14}Fe_{79}B_6Cu_1$ and $Nd_{14}Fe_{79}B_6Ga_1$ alloys.

To determine their magnetizability, magnetic properties of the bonded anisotropic magnets magnetized in magnetic fields of 10 to 100 kOe were measured with an automatic fluxmeter. FIG. 7 shows the residual magnetic flux densities of the magnets magnetized in the individual magnetic fields in terms of the ratio to the residual magnetic flux densities resulting from the magnetization in a magnetic field of 100 kOe.

As is obvious from FIG. 7, the magnet added with copper proved to be more magnetizable than the one added with gallium.

What is claimed is:

1. A rare-earth alloy anisotropic powder consisting essentially of, in atomic percent, over 12 percent and not more than 20 percent of R (R is at least one of neodymium and praseodymium or at least one of them and one or more rare-earth elements), not less than 4 percent and not more than 10 percent of boron, not less than 0.05 percent and not more than 5 percent of copper and the rest that consists essentially of iron and unavoidable impurities, the alloy powder being made up of flat crystal grains having mean thickness h (the shortest measure), d not smaller than 0.01 μm and not larger than 0.5 μm and ratio d/h not smaller than 2, d being the mean measure of the grains taken at right angles to the widthwise direction thereof, and the alloy powder being magnetically anisotropic.

2. A rare-earth alloy anisotropic powder according to claim 1, in which up to 20 atomic percent of the iron contained is replaced with cobalt.

3. A rare-earth alloy anisotropic powder according to claims 1 or 2, in which the residual magnetic flux density in the direction of the axis of easy magnetization is not lower than 9 kG.

4. A rare-earth alloy anisotropic magnet consisting of a rare-earth alloy anisotropic powder according to claims 1 or 2 and not less than 10 percent and not more than 50 percent, both by volume, of resin.

5. A rare-earth alloy anisotropic magnet consisting of a hot-compressed product of a rare-earth alloy anisotropic powder according to claims 1 or 2.

6. A process for preparing a rare-earth alloy anisotropic powder comprising the steps of:

melting an alloy consisting essentially of, in atomic percent, over 12 percent and not more than 20 percent of R (R is at least one of neodymium and praseodymium or at least one of them and one or more rare-earth elements), not less than 4 percent and not more than 10 percent of boron, not less than 0.05 percent and not more than 5 percent of copper and the rest that consists essentially of iron and unavoidable impurities;

making thin ribbons made up of fine grains by quenching the melted alloy;

putting the thin ribbons or a powder obtained by grinding the thin ribbons into a metal container and hermetically sealing the metal container after replacing the inner atmosphere thereof with a vacuum or an inert atmosphere; and rolling the thin ribbons or powder together with the metal container at a temperature not lower than 500° C. and not higher than 900° C.

7. A process for preparing a rare-earth alloy anisotropic powder according to claim 6 in which up to 20 atomic percent of the iron contained is replaced with cobalt.

8. A process for preparing a rare-earth alloy anisotropic powder according to claims 6 or 7 in which the thin ribbons or powder is preliminarily formed between said steps of making thin ribbons and sealing the metal container.

9. A process for preparing a rare-earth alloy anisotropic powder according to claims 6 or 7 in which the thin ribbons or powder is preliminarily worked, together with the metal container, at a temperature lower than 800° C. between said steps of sealing the metal container and rolling.

10. A process for preparing a rare-earth alloy anisotropic powder according to claims 6 or 7 in which the product obtained by rolling the thin ribbons or powder together with the metal container is ground into a powder.

11. A process for preparing a rare-earth alloy anisotropic powder according to claims 6 or 7 in which the rolled product is heat treated at a temperature not lower than 400° C. and not higher than 800° C.

12. A process for preparing a rare-earth alloy anisotropic powder according to claims 6 or 7 in which the powder obtained by grinding the rolled product is heat treated at a temperature not lower than 400° C. and not higher than 800° C.

13. A process for making a rare-earth alloy anisotropic magnet comprising the steps of:

melting an alloy consisting of, in atomic percent, over 12 percent and not more than 20 percent of R (R is at least one of neodymium and praseodymium or at least one of them and one or more rare-earth elements), not less than 4 percent and not more than 10 percent of boron, not less than 0.05 percent and not more than 5 percent of copper and the rest that consists of iron and unavoidable impurities;

making thin ribbons made up of fine grains by quenching the melted alloy;

putting the thin ribbons or a powder obtained by grinding the thin ribbons into a metal container and hermetically sealing the metal container after replacing the inner gas atmosphere thereof with a vacuum or an inert atmosphere;

rolling the thin ribbons or powder together with the metal container at a temperature not lower than 500° C. and not higher than 900° C.; and mixing a powder prepared by grinding the rolled product with not less than 10 percent and not more than 50 percent by volume of resin into a desired shape.

14. A process for making a rare-earth alloy anisotropic magnet comprising the steps of:

melting an alloy consisting of, in atomic percent, over 12 percent and not more than 20 percent of R (R is at least one of neodymium and praseodymium or at least one of them and one or more rare-earth elements), not less than 4 percent and not more than 10 percent of boron, not less than 0.05 percent and not more than 5 percent of copper and the rest that consists of iron and unavoidable impurities;

making thin ribbons made up of fine grains by quenching the melted alloy;

putting the thin ribbons or a powder obtained by grinding the thin ribbons into a metal container and hermetically sealing the metal container after replacing the inner gas atmosphere thereof with a vacuum or an inert atmosphere;

rolling the thin ribbons or powder together with the metal container at a temperature not lower than 500° C. and not higher than 900° C.; and hot-compressing a powder prepared by grinding the rolled product into a desired shape.

15. A process for preparing a rare-earth alloy anisotropic magnet according to claims 13 or 14 in which the thin ribbons or powder is preliminarily formed between said steps of making thin ribbons and sealing the metal container.

16. A process for preparing a rare-earth alloy anisotropic magnet according to claims 13 or 14 in which the thin ribbons or powder is preliminarily worked, together with the metal container, at a temperature lower than 800° C. between said steps of sealing the metal container and rolling.

17. A process for preparing a rare-earth alloy anisotropic magnet according to claims 13 or 14 in which the rolled product is heat treated at a temperature not lower than 400° C. and not higher than 800° C.

18. A process for preparing a rare-earth alloy anisotropic magnet according to claims 13 or 14 in which the powder obtained by grinding the rolled product is heat treated at a temperature not lower than 400° C. and not higher than 800° C.

* * * * *

UNITED STATES PATENT AND TRADEMARK OFFICE

CERTIFICATE OF CORRECTION

PATENT NO. : 5,009,706

DATED : April 23, 1991

INVENTOR(S) : H.Sakamoto et al

It is certified that error appears in the above-identified patent and that said Letters Patent is hereby corrected as shown below:

On the title page and column 1, line 1, delete "ANTISOTROPIC" and insert --ANISOTROPIC--.

Column 14, in claim 3, line 2, delete "claims" and insert --claim--.

Column 14, in claim 4, line 3, delete "claims" and insert --claim--.

Column 14, in claim 5, line 3, delete "claims" and insert --claim--.

Column 14, in claim 8, line 2, delete "claims" and insert --claim--.

Column 14, in claim 9, line 2, delete "claims" and insert --claim--.

Column 14, in claim 10, line 2, delete "claims" and insert --claim--.

Column 14, in claim 11, line 2, delete "claims" and insert --claim--.

Column 14, in claim 12, line 2, delete "claims" and insert --claim--.

Column 16, in claim 15, line 2, delete "claims" and insert --claim--.

Column 16, in claim 16, line 2, delete "claims" and insert --claim--.

UNITED STATES PATENT AND TRADEMARK OFFICE

CERTIFICATE OF CORRECTION

PATENT NO. : 5,009,706

DATED : April 23, 1991

INVENTOR(S) : H. Sakamoto et al

It is certified that error appears in the above-identified patent and that said Letters Patent is hereby corrected as shown below:

Column 16, in claim 17, line 2, delete "claims" and insert --claim--.

Column 16, in claim 18, line 2, delete "claims" and insert --claim--.

Signed and Sealed this

First Day of December, 1992

*Attest:*

DOUGLAS B. COMER

*Attesting Officer*

*Acting Commissioner of Patents and Trademarks*